US005879151A

United States Patent [19]

Schultz et al.

[11] Patent Number: 5,879,151

[45] Date of Patent: Mar. 9, 1999

[54] VOTIVE CANDLE HOLDER LID, CANDLE PACKAGE AND RELATED METHOD

[75] Inventors: Marissa A. K. Schultz, Racine; Marianne D. Davison, Milwaukee, both of Wis.

[73] Assignee: S. C. Johnson & Son, Inc., Racine, Wis.

[21] Appl. No.: 994,311

[22] Filed: Dec. 19, 1997

[51] Int. Cl.[6] ..... E23D 3/16

[52] U.S. Cl. ..... 431/291; 215/320; 215/354

[58] Field of Search ..... 431/291; 220/784, 220/254, 367.1, 369; 215/320, 307, 354

[56] References Cited

U.S. PATENT DOCUMENTS

| | | | |
|---|---|---|---|
| 659,931 | 10/1900 | Knobeloch . | |
| 1,077,751 | 11/1913 | Pribnow . | |
| 1,975,496 | 10/1934 | Barrett | 431/291 |
| 2,009,874 | 7/1935 | Cauley . | |
| 2,102,886 | 12/1937 | Conner . | |
| 3,298,415 | 1/1967 | Klygis | 215/320 |
| 3,321,071 | 5/1967 | Elwell . | |
| 3,561,668 | 2/1971 | Bergstrom . | |
| 3,853,221 | 12/1974 | Boyd . | |
| 4,524,408 | 6/1985 | Minera . | |
| 4,544,351 | 10/1985 | Marsicano . | |
| 4,556,147 | 12/1985 | Magnussen, Jr. . | |
| 4,697,703 | 10/1987 | Will . | |
| 5,005,759 | 4/1991 | Bouche . | |
| 5,165,947 | 11/1992 | Colucci et al. . | |
| 5,213,215 | 5/1993 | Prevot . | |
| 5,328,045 | 7/1994 | Yoshida | 220/254 |
| 5,460,283 | 10/1995 | Ma Cartney et al. | 215/354 |

*Primary Examiner*—Carroll B. Dority
*Attorney, Agent, or Firm*—J. William Frank, III

[57] ABSTRACT

A lid for use on a holder with a candle disposed therein, the holder having a lip defining an open mouth. The lid includes a central cap and a projection depending outwardly from the central cap. The projection includes an inner wall, which is configured to surround and abut the candle in the holder when the lid is in place on the holder, and an outer wall, which is configured to abut the holder when the lid is in place on the holder. A peripheral flange extends outwardly from the outer wall and is configured to abut the lip of the holder when the lid is in place on the holder. In another aspect, a candle package includes the lid, in combination with the holder and the candle. Also, a method of packaging a candle utilizes such a candle package.

16 Claims, 4 Drawing Sheets

VOTIVE CANDLE HOLDER LID, CANDLE PACKAGE AND RELATED METHOD

FIELD OF THE INVENTION

This invention relates to a lid for a votive candle holder, and more particularly, to a lid which fits over a votive candle and the holder to hold the votive candle in place in the holder during storage, shipping and display. This invention also relates to a candle package that includes the lid, in combination with the holder and the candle, as well as a method of packaging a candle utilizing such a candle package.

BACKGROUND OF THE INVENTION

FIG. 6 shows a votive candle 1, or simply a "votive." A votive generally has a basically cylindrical shape, with a flat base 1*b* and a wick 1*w* extending from its top. Typically, a votive is displayed and burned in a decorative glass holder or jar 10, illustrated in schematic elevation, which diffuses the light from the flame and collects the wax that melts off the candle. Votives and holders are often displayed together at the point of sale, but have generally been packaged separately for shipping and storage. Manufacturers and suppliers, especially those that produce and/or sell both candles and glassware, would prefer to be able to prepackage votives and holders as displayable units.

Often, a votive is not meant to fit snugly within its holder, but instead rests loosely in the holder. In order to prepackage a votive and holder, an initial challenge is to properly orient the votive in the holder. This is especially true if the bottom of the holder is significantly larger or shaped differently than the votive. Even if the votive is initially placed correctly, it can be difficult to maintain the proper positioning. One logical approach would be to glue the base of the votive to the bottom of the holder. Even so, the votive would need to be kept in place at least until the glue dries. Thus, there is a need in the art for a simple mechanism to properly orient a votive in a holder during production.

Once a votive is glued in place in a holder, the votive/holder unit will invariably be jostled (e.g., bumped or moved) during shipping and storage. As a result, either the glue or the wax to which the glue is adhered can break, or the attachment between them severed, dislodging the votive so that it is free to tumble around within or out of the holder. If it ends up displaced, the votive cannot easily be righted, especially if the votive and holder are packaged in an outer container, which must be opened to access the candle and then resealed if the container is intended for display. A dislodged votive can also lead to unsightly wax scuff marks on the inner wall of the holder, chips in the votive itself, or loose wax or glue fragments. Therefore, there is also a need in the art for a simple mechanism to prevent the votive from becoming dislodged from the bottom of the holder. There is a further need for a mechanism that, should the votive become dislodged, prevents the votive from becoming displaced or contacting the inner wall of the holder.

Further, when a glued votive breaks loose from the bottom of the holder, wax or glue fragments can stick to the bottom of the holder or the base of the votive, making it difficult to properly reposition the dislodged votive. Therefore, there is an additional need for a mechanism which can maintain the position of the votive without using glue or other adhesives.

Finally, votives are often decoratively dyed or fragranced, features which should be apparent when the votive is displayed in a store. Therefore, it would be preferable that the above mechanism or mechanisms not obscure or detract from the appearance or aroma of the displayed votive.

U.S. Pat. Nos. 4,967,703; 3,561,668; 2,102,886; and 2,009,874 discuss various containers for articles other than candles, and U.S. Pat. No. 4,544,351 discusses a candle holder. None of these patents, however, addresses the particular problems discussed above.

SUMMARY OF THE INVENTION

The present invention addresses the forgoing needs in the art by providing a lid which fits over a votive candle and holds it in place in a holder during storage, shipping and display.

According to one aspect, the present invention relates to a lid for use on a holder with a candle disposed therein, the holder having a lip defining an open mouth. The lid includes a central cap and a projection depending outwardly from the central cap. The projection includes an inner wall, which is configured to surround and abut the candle in the holder when the lid is in place on the holder, and an outer wall, which is configured to abut the holder when the lid is in place on the holder. A peripheral flange extends outwardly from the outer wall and is configured to abut the lip of the holder when the lid is in place on the holder.

According to another aspect, the present invention relates to a lid, for use on a holder with a candle disposed therein, the holder having a lip defining an open mouth. The lid includes a central cap, a peripheral flange substantially parallel to the central cap, and a tapered projection depending from the lid between the central cap and the peripheral flange. The projection includes an inner wall, depending at an incline away from the central cap, and an outer wall, depending at an opposing incline away from the peripheral flange.

According to yet another aspect, the present invention relates to a method of packaging a candle, including the steps of placing the candle in a holder having a lip defining an open mouth and enclosing the candle in the holder with a lid. The lid includes (i) a central cap, (ii) a projection depending outwardly from the central cap, the projection comprising an inner wall, which surrounds and abuts the candle in the holder, and an outer wall, which abuts the holder, and (iii) a peripheral flange extending outwardly from the outer wall and configured to abut the lip of the holder.

These and other objects, features, and advantages will be more evident from the following description and drawings, in which like reference numerals relate to like elements throughout.

DETAILED DESCRIPTION OF THE PREFERRED EMBODIMENTS

Figure 2:
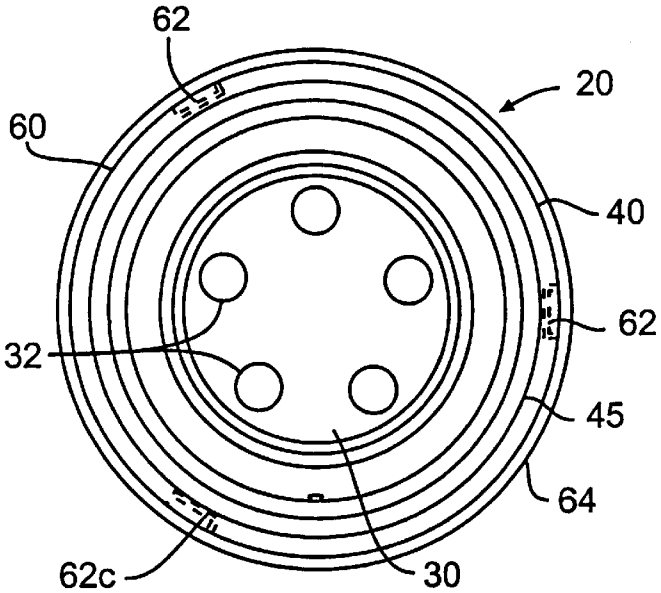
FIG. 2 is a top plan view of the lid of FIG. 1.
Figure 1:
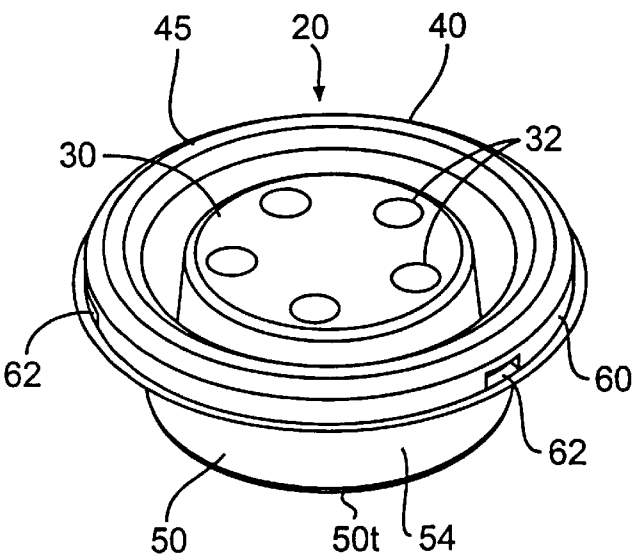
FIG. 1 is a perspective view of a votive candle holder lid according to an embodiment of the present invention.
Figure 3:
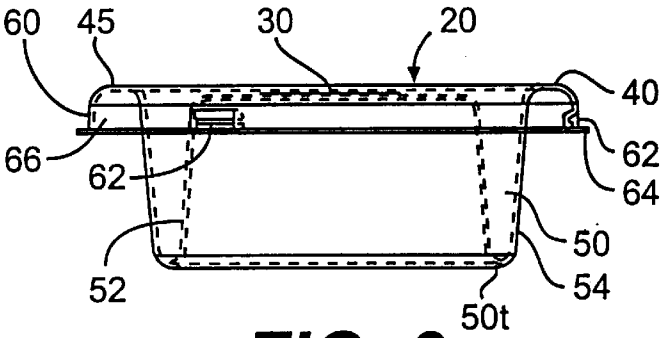
FIG. 3 is an elevational view of the lid of FIG. 1.

FIGS. 1 through 3 show a candle holder lid 20 according to a preferred embodiment of our invention. The lid 20 includes a central cap 30 and a rim 40, which includes a peripheral flange 45. Depending from the lid 20 between the cap 30 and the rim 40 is a downward projection 50, which includes an inner wall 52 and an outer wall 54.

Figure 6:
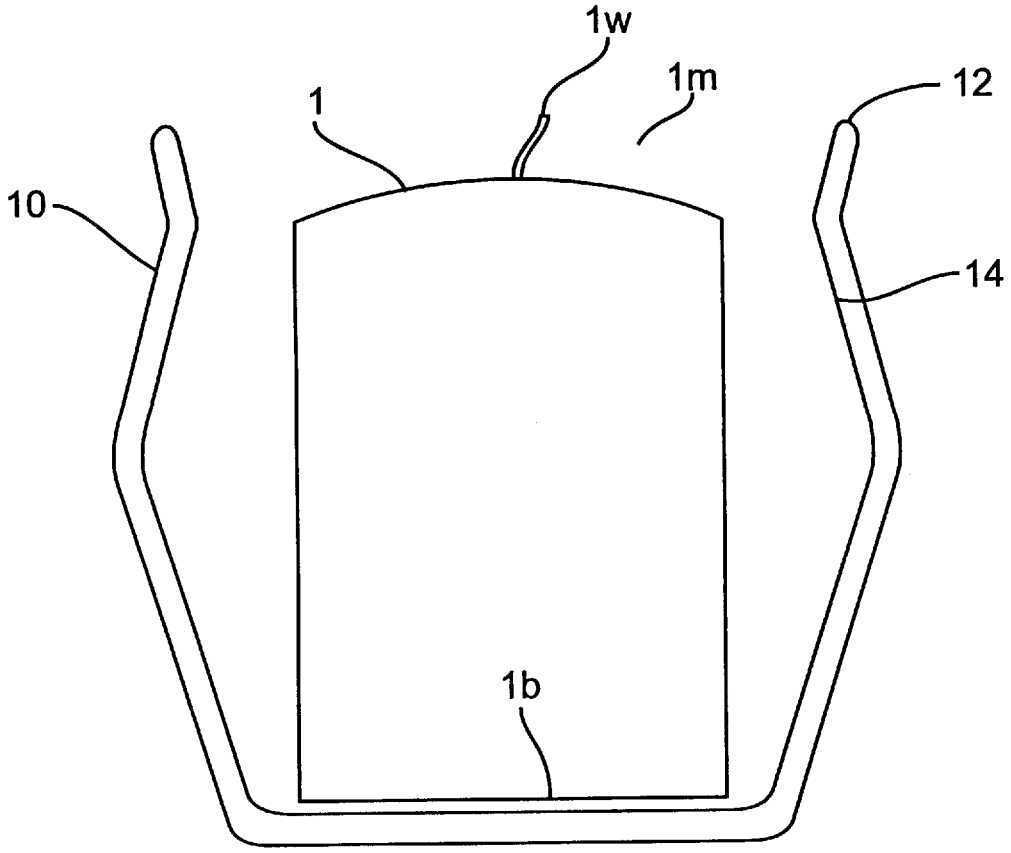
FIG. 6 is a schematic elevational view of a votive candle in a holder.

When the lid of this embodiment is viewed from above or below, the cap 20 is circular, the peripheral flange 45 is annular, and the projection 50 extends completely around the circumference of the cap, defining a cavity beneath the central cap. This lid is designed for use with a substantially cylindrical candle and a correspondingly round-mouthed candle holder, shaped in cross section like those shown in FIG. 6. Of course, the lid can be shaped differently to match different candles and/or holders. The shapes of the flange 45 and the outer wall 54 of the projection 50 are driven primarily by the shape of the holder 10. The flange 45 is shaped to match the lip 12 of the holder, and the shape of the outer wall 54 of the projection is shaped to abut the inner surface of the wall 14 of the holder. Therefore, for example, if the mouth of the holder were square in shape, so too would be the peripheral flange 45. The shapes of the inner wall 52 and the central cap 30, on the other hand, are dependent on the shape of the candle. The inner wall 52 is shaped to abut the candle 1, usually resulting in a cap 30 shaped generally like the top of the candle.

In the illustrated embodiment, the cap 30 is slightly recessed below the peripheral flanges 45. This is due to the particular dimensions of the candle and holder for which the lid is designed. The cap is located to closely cover the wick 1*w* of the candle when the flange rests on the lip 12 of the holder. The height of the cap 30 in relation to the flange 45 can be varied depending on the height of the candle relative to the holder lip 12.

The intersections between the cap 20 and the inner wall 52 and between the flange 45 and the outer wall 54 are curved. Some curvature will naturally result during the formation processes discussed below, with larger curvatures being easier to form. In the illustrated embodiment, the intersection between the flange 45 and the outer wall 54 is preferably larger than production concerns dictate, however, in order to match up with the curved lip 12 of the holder 10.

Because the lid 20 of the illustrated embodiment is thermoformed, as discussed below, an annular trough is formed between the cap 30 and the flange 45. This might not occur if another formation method is used. For example, if the lid 20 is injection molded, the top surfaces of the flange 45 and central cap 30 can be substantially contiguous, with the projection 50 extending from the bottom thereof.

In this embodiment, the projection 50 is tapered so that the inner wall 52 and outer wall 52 are slanted toward one another. While not necessary to the invention, this feature is preferred because it facilitates placement of the lid 20 onto the holder 10, permitting the projection 50 to slip more easily between the candle 1 and the wall 14 of the holder 10. In fact, if the candle is out of place in the holder 10 as the lid 20 is placed on the holder 10, the tapered inner wall 52 will contact and help to properly center the candle. This makes the initial placement of the candle 1 in the holder 10 less critical, facilitating production. Similarly, tapering the outer wall 54 permits more variation in the relative positioning of the lid 20 and holder 10 during insertion of the lid 20. Because the outer wall 54 is tapered, the projection 50 has a smaller outer diameter at its tip 50*t*. Therefore, even if the lid 10 and holder 20 are slightly askew, the projection 50 will fit into the mouth 1*m* of the holder 10. As the lid 20 is moved into place, the tapered outer wall 54 will abut the inside of the holder 10, serving as a self-centering mechanism.

The rim 40 of the lid 20 of the illustrated embodiment also includes a skirt 60 depending from the outer edge of the flange 45. While not necessary to the present invention, the skirt 60 is a preferable feature of the rim 40. The skirt 60, flange 45 and outer wall 54 combine to define a channel 66 in which the lip 12 of the holder 10 sits when the lid 20 is placed on the holder 10. This keeps the lid 20 more securely in place. As it does with the outer wall 54, the flange 45 has a curved intersection with the skirt 60.

In order to allow for slight variations in holder sizes, the skirt 60 can further be provided with a plurality of inwardly projecting bosses 62. These bosses extend into the channel 66 and abut the outer surface of the wall 14 of the holder, providing a more snug fit between the lid 20 and the holder 10. The bosses 62 can be of any shape, but are preferably tapered to better permit the lid 20 to slide on and off the holder 10, and also to facilitate mold release during lid formation. As will be appreciated by those skilled in the art, the distance by which the bosses 62 can extend into the channel 66, while still being formable simultaneously with the rest of the lid 20, will depend upon the sophistication of the production equipment. Also, if necessary, the bosses 62 can be formed in a separate, subsequent process, but this will increase production costs. If possible during formation, the bosses 62 can extend inwardly far enough to require that the skirt 60 be flexed outwardly slightly in order to seat the holder lip 12 in the channel 66 of the lid 20, in order to provide a friction fit between the lid 20 and the holder 10.

In the illustrated embodiment, an outer lip 64 extends out from the base of the skirt 60. This feature is generally a product of the manufacturing process, discussed below, and can be reduced or eliminated without negatively impacting the operability of the invention.

If the candle 1 is scented, the cap 30 is preferably perforated to permit consumers to smell the candle through the lid 20. In the preferred embodiment, the cap 30 is provided with a series of holes 32 for this purpose. The size, shape, and distribution of these holes 32 are generally not critical, with the exception that increasing the total area of the perforations (i.e., more or larger perforations) will allow greater dispersion of scent. The holes 32 are preferably off center or quite small to avoid having the wick 1*w* of the candle 1 extend through the cap 30.

As discussed earlier, the dimensions of the lid 20 of the present invention will vary depending on the dimensions and shapes of the candle 1 and holder 10. As for the illustrated embodiment, by way of example, the lid 20 was designed for use with a generally cylindrical candle 1 and a round-mouthed holder 10 shaped in cross section like those shown in FIG. 6. Of course, these dimensions are merely explanatory and each may be changed without departing from the scope of the invention. In this example, the candle is approximately 38.1 mm in diameter and 50.8 mm high. The holder mouth 1*m* is approximately 63.5 mm in diameter, and the holder lip 12 is approximately 2.54 mm thick. When viewed from above, the lid 20 has an outer diameter, measured from the outer edge of the outer lip 64, of approximately 72.5 mm. The annular outer lip 64 has an inner diameter of approximately 68.4 mm, which is the outer diameter of the channel 66 at the base of the skirt 60. The cap 30 has a diameter of approximately 36.5 mm.

The lid 20 is approximately 25.4 mm tall, from the upper surface of the peripheral flange 45 to the lower tip 50*t* of the projection 50. The cap 30 is slightly recessed, by approximately 1.0 mm, below the upper surface of the peripheral flange 45.

The intersections of the cap 30 and the flange 45, respectively, with the projection 50 have radii of curvatures on the order of 2 mm. The inner wall 52 and the outer wall 54 each have an approximately 5° draft. Thus, just below the intersection between the flange 45 and the outer wall 54, the projection 50 has an outer diameter of approximately 54.5 mm, which is the inner diameter of the channel 66 at that height. Just above its curved tip 50*t*, the projection has an outer diameter of approximately 50.6 mm. Similarly, just below the intersection between the cap 30 and the inner wall 52, the projection 50 has an inner diameter of approximately 39.6 mm. The outer and inner walls 54, 52 come together at the tip 50*t* of the projection, forming a radius of curvature of approximately 1.27 mm. Just above its curved tip 50*t*, the projection has an inner diameter of approximately 43.4 mm.

The skirt 60 extends approximately 6.01 mm down from the flange 45, and the radius of curvature at the intersection between the skirt and the flange is approximately 1.88 mm. The bosses 62, of which there are three spaced generally evenly about the skirt, are approximately 6.4 mm long when measured along the circumference of the skirt 60. The bosses angle up from the outer lip 64, and have a rectangular contact surface 62*c* centered vertically approximately 1.61 mm up the skirt 60 from the outer lip 64. Each boss extends approximately 1.27 mm into the channel 66, or to a point approximately 32.9 mm from the center axis of the lid 20.

In the illustrated embodiment, there are five holes 32, each approximately 6.35 mm in diameter, spaced generally evenly (approximately 72° apart) about the cap 30. Each hole 32 is centered on an imaginary circle, substantially concentric with the cap and having a diameter of approximately 27.6 mm. Thus, the holes 32 are each spaced approximately 1.78 mm from the perimeter of the cap 30.

The lid 20 of the illustrated embodiment is preferably thermoformed of a laminate of polyvinyl chloride (PVC) and nylon. This laminate has been selected for its thermoformability, clarity, and resistance to reaction with the oils and synthetic compositions typically used as fragrances in candles. The PVC, which has good transparency and is relatively inexpensive, is provided for structural stability, while the nylon layer is provided on the inside of the lid 20 (i.e., the side that is exposed to the candle) in order to buffer the PVC from the fragrance therein. The PVC and nylon are laminated together using a suitable adhesive, such as a polyurethane ether based adhesive. The lid is preferably thermoformed with the PVC on the mold side and the nylon on the plug side. The illustrated laminate is 20 mil thick, comprised of a 17 mil layer of PVC and a 3 mil layer of nylon. We recognize that PVC/nylon laminates having other thicknesses can be employed, depending on the particular characteristics desired. For example, a thicker PVC layer increases the structural strength of the lid.

Rather than PVC, any of a number of polyesters, polyethylene terephthalate (PET), recycled PET (RPET), virgin PET (VPET), a PET glycol copolymer (PETG), poly 1,4 cyclohexylene dimethylene terephthalate copolymer (PCTG), a coextrusion of RPET and PETG, a coextrusion of RPET and PCTG, or the like, can be used, depending on the degree of transparency desired.

We also recognize that other methods besides thermoforming, such as injection molding or the like are suitable for the present invention. Other materials can also be used in place of the PVC/nylon laminate, depending on the particular fragrance resistance and light transmissivity (i.e., transparent, translucent, etc.) qualities desired. Some materials that may be suitable include polycarbonates, PET, Questra Coextrusion™ (Dow Chemical) polystyrene, Questra Monolayer™ (Dow Chemical) polystyrene, and polystyrene/polypropylene alloys.

If it is desired that the lid 20 be transparent, non-transparent materials, such as the Questra™ materials or the polystyrene/polypropylene alloys, may not be suitable. The next factor to consider is chemical resistance to the fragrance of the candle. In order to determine whether a particular material is suitable for use with a particular candle, two tests can be performed. First, the test material can be subjected to direct contact with the fragrance and examined for signs of reaction, such as degradation, deformation or clouding. Since this exposure is much more concentrated than will be encountered in actual use, the observation period can be limited to a matter of days or even hours. Second, lids can be formed of the test material and placed on holders with fragranced candles therein. The samples can then be stored at different temperatures and inspected periodically over, for example, a number of months for signs of reaction.

Figure 4:
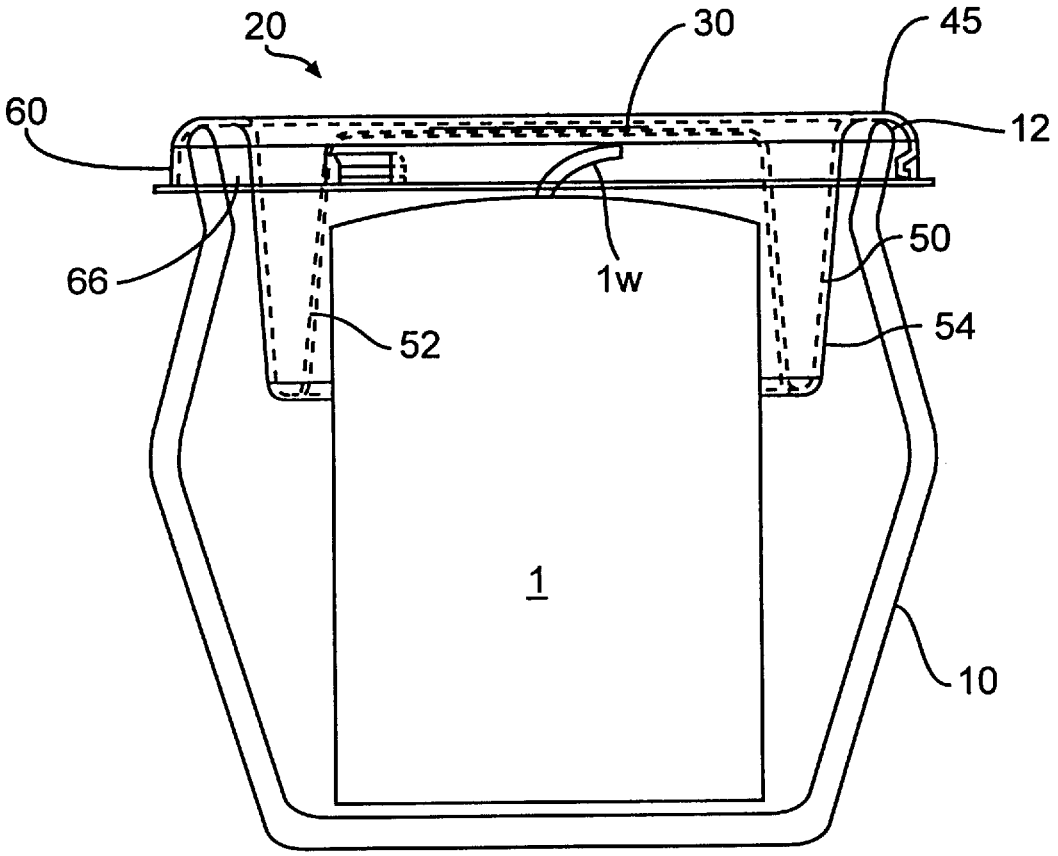
FIG. 4 is a front schematic elevational view of the lid of FIG. 1 in combination with a votive holder and a votive candle.

In operation, the candle is placed in the holder 10, then the lid 20 is placed on the holder 10. When the lid 20 of the illustrated embodiment is in place on the holder 10 as seen in FIG. 4, the peripheral flange sits on the lip 12 of the holder 10. As described earlier, the lip of the holder sits in the channel 66 defined by the outer skirt 60, peripheral flange 45 and outer wall 54. The outer wall 54 of the projection 50 abuts the inner surface of the wall 14 of the holder 10. The inner wall 52 of the projection 50 surrounds and abuts the candle in the holder 10. The central cap 30 fits closely over the top of the wick 1*w* of the candle 1.

Figure 5B:
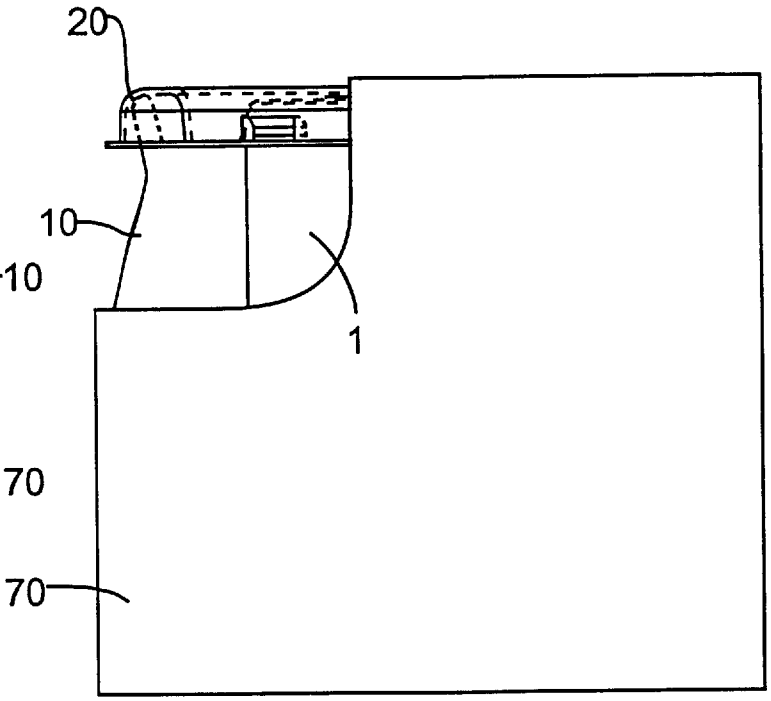
FIGS. 5A and 5B are, respectively, front and side elevational views of the lid/holder/candle combination of FIG. 4 in combination with an outer container.
Figure 5A:
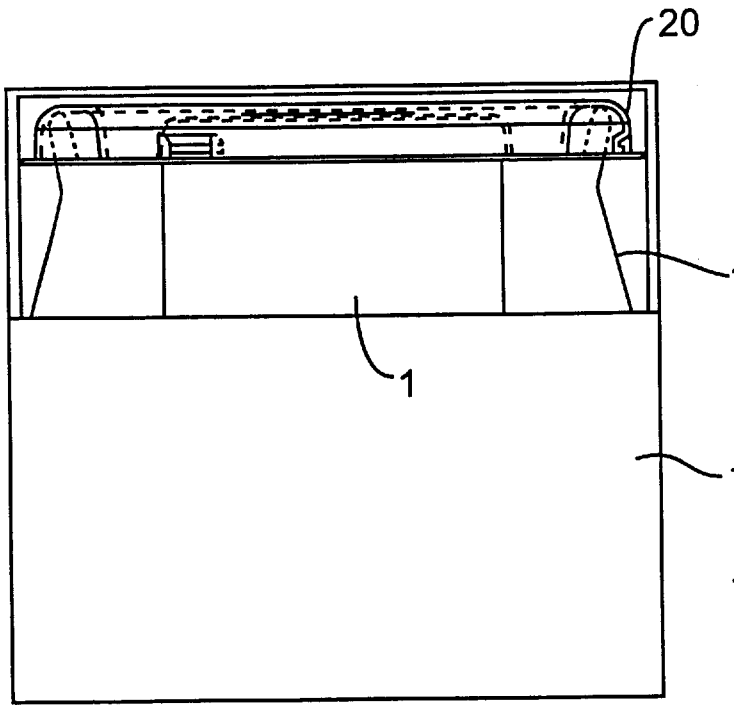

An outer container can be provided for encasing the lid 20 and the holder 10 to hold the lid 20 and the holder 10 together with the candle 1 enclosed thereby. In addition, the container can be adorned with decorative markings, trademarks, certification marks, customer service information, instructions, warnings, and the like, for point of sale display. This container can take any of innumerable forms, including a simple box. However, as shown in FIGS. 5A and 5B, the container 70 is preferably configured to take advantage of the features of the lid 20 of the present invention. For example, the container can be partially cutaway to partially expose the candle 1, holder 10 and lid 20. The illustrated container 70 is a box with a major portion of its top front quadrant removed, exposing a portion of the candle/holder/lid combination. This permits the visual display of the candle 1 and holder 10 while in the container 70, because the lid 20 is transparent. The open container, in combination with the holes 32 (not visible in these views) in the lid 20, also permits the aroma of the candle to escape through the open part of the container. Thus, the container can serve the dual purposes of holding together and displaying the candle/holder/lid combination.

While the present invention has been described with respect to what is at present considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. For example, the projection 50 need not be continuous, but can be a series of smaller projections disposed around the perimeter of the cap 30. The flange 45, cap 30 and/or the inner and outer walls 52, 54 of the projection 50 need not be flat, but can be slanted, peaked or arched when viewed in profile, even curved to the point of eliminating any discernable intersection between these features.

As discussed, the shape of the lid 20 can be varied to accommodate candles and/or holders of varying shapes and sizes. For example, the lid can be designed for use with candles shaped differently than traditional votive candles. Also, rather than an outer container 70, the lid 20 can be friction fit or shrink-wrapped to the holder 10. Therefore, the scope of the following claims is intended to be accorded the broadest reasonable interpretation so as to encompass all such modifications and equivalent structures and functions.

INDUSTRIAL APPLICABILITY

A lid according to our invention is particularly suitable for use with votive candles. The lid can be used, particularly in combination with an outer container, to enclose and hold in place a votive candle in a votive candle holder. The lid properly orients and holds the candle in a manner to prevent it from becoming displaced in the holder or contacting the side of the holder, thereby preventing the candle from being damaged and the holder from being scuffed. If the lid is transparent or translucent, it permits the candle and holder to be viewed therethrough. If the lid is provided with a perforated cap, the fragrance can emanate therefrom. Additionally, the lid protects the candle and holder from dust and other foreign particles.

We claim:

1. A candle package comprising:

a holder having a lip defining an open mouth;

a candle disposed in the holder; and a lid comprising:

(i) a central cap;

(ii) a projection depending from an outer portion of the central cap, the projection comprising an inner wall, which is configured to surround and abut the candle in the holder when the lid is in place on the holder, and an outer wall, which is configured to abut the holder when lid is in place on the holder; and (iii) a peripheral flange extending outwardly from the outer wall and configured to abut the lip of the holder when the lid is in place on the holder.

2. The candle package of claim 1, further comprising an outer container encasing the lid and the holder so as to hold the lid and the holder together.

3. The candle package of claim 2, wherein the outer container is cutaway, in part, to partially expose the lid and the holder.

4. The lid of claim 1, wherein the lid is formed of a laminate of polyvinyl chloride and nylon.

5. A candle package comprising:

a holder having a lip defining an open mouth;

a candle disposed in the holder; and a lid comprising:

(i) a central cap;

(ii) a peripheral flange substantially parallel to the central cap; and (iii) a tapered projection depending from the lid between the central cap and the peripheral flange, the projection comprising an inner wall, depending at an incline away from the central cap, and an outer wall, depending at an opposing incline away from the peripheral flange.

6. The candle package of claim 5, further comprising an outer container encasing the lid and the holder so as to hold the lid and the holder together.

7. The candle package of claim 6, wherein the outer container is cutaway, in part, to partially expose the lid and the holder.

8. The lid of claim 5, wherein the lid is formed of a laminate of polyvinyl chloride and nylon.

9. A method of packaging a candle, comprising:

placing the candle in a holder having a lip defining an open mouth; and enclosing the candle in the holder with a lid, the lid comprising (i) a central cap, (ii) a projection depending outwardly from the central cap, the projection comprising an inner wall, which surrounds and abuts the candle in the holder, and an outer wall, which abuts the holder, and (iii) a peripheral flange extending outwardly from the outer wall and configured to abut the lip of the holder.

10. The method of claim 9, further comprising the step of, after closing the candle in the holder with the lid, enclosing the candle, the holder and the lid within an outer container.

11. The method of claim 9, wherein the lid further comprises an outer skirt depending from the peripheral flange so that the outer skirt, the peripheral flange and the outer wall combine to define a channel in which the lip of the holder sits.

12. The method of claim 11, wherein the lid further comprises a plurality of bosses extending inwardly from the outer skirt to abut the holder.

13. The method of claim 9, wherein the lid is perforated.

14. The method of claim 9, further comprising the step of encasing the lid and the holder, with the candle enclosed thereby, in a container so as to hold the lid and the holder together.

15. The method of claim 14, wherein the container is cutaway, in part, to partially expose the lid and the holder.

16. The method of claim 9, wherein the lid is formed of a laminate of polyvinyl chloride and nylon.

* * * * *